US010106230B2

(12) United States Patent
Richenberg

(10) Patent No.: US 10,106,230 B2
(45) Date of Patent: Oct. 23, 2018

(54) BIOMIMIC DESIGN STABILIZING FIN OR KEEL FOR SURFACE PLANING OR SUBMERGED WATERCRAFT

(71) Applicant: Randal Richenberg, New Smyrna Beach, FL (US)

(72) Inventor: Randal Richenberg, New Smyrna Beach, FL (US)

( * ) Notice: Subject to any disclaimer, the term of this patent is extended or adjusted under 35 U.S.C. 154(b) by 37 days.

(21) Appl. No.: 15/150,136

(22) Filed: May 9, 2016

(65) Prior Publication Data

US 2016/0355240 A1 Dec. 8, 2016

Related U.S. Application Data

(60) Provisional application No. 62/170,074, filed on Jun. 2, 2015.

(51) Int. Cl.
*B63B 35/79* (2006.01)

(52) U.S. Cl.
CPC ..... *B63B 35/7926* (2013.01)

(58) Field of Classification Search
CPC ... B63B 35/793; B63B 35/7906; B63B 35/79; B63B 2035/813
USPC ..... 441/79
See application file for complete search history.

(56) References Cited

U.S. PATENT DOCUMENTS

| | | | | |
|---|---|---|---|---|
| 4,037,279 | A * | 7/1977 | Ziebart | B63B 35/81 114/127 |
| 4,733,496 | A * | 3/1988 | Wallner | B63B 35/793 114/133 |
| 5,273,472 | A * | 12/1993 | Skedeleski | B63B 35/7926 114/140 |
| 5,306,188 | A * | 4/1994 | Skedeleski | B63B 35/7926 114/140 |
| 5,480,331 | A * | 1/1996 | Lewis | B29D 99/0025 114/127 |
| 7,896,718 | B2 * | 3/2011 | Jones | B63B 35/7926 441/79 |
| 9,505,471 | B2 * | 11/2016 | Wunner | B63B 35/7926 |
| 9,540,080 | B2 * | 1/2017 | Longo | B63B 35/7909 |
| 2013/0244514 | A1 * | 9/2013 | Scott | B63B 35/7926 441/79 |
| 2015/0104988 | A1 * | 4/2015 | Potter | B63B 35/7926 441/79 |

FOREIGN PATENT DOCUMENTS

| | | | | |
|---|---|---|---|---|
| EP | 0079113 | A1 * | 5/1983 | B63B 3/38 |
| WO | WO-9219492 | A1 * | 11/1992 | B63B 35/7926 |

* cited by examiner

*Primary Examiner* — Joshua T Kennedy

(57) ABSTRACT

A stabilizing fin or keel utilizing biomimic design features for use on surface planing or submerged watercraft to provide increased dimensional stability, control and efficiency.

4 Claims, 6 Drawing Sheets

BIOMIMIC DESIGN STABILIZING FIN OR KEEL FOR SURFACE PLANING OR SUBMERGED WATERCRAFT

FIELD OF INVENTION

The invention as presented relates to surface planing or submersible watercraft such as surfboards, kiteboards, sailboats, submersible craft, etc. and more specifically to fins or keels employed for dimensional stability and control of watercraft while in motion through water either on water surface or submerged.

BACKGROUND OF INVENTION

This invention relates to surface planing or submerged watercraft such as surfboards, kiteboards, sailboats, submersible craft, etc. and specifically to fins or keels of which the primary function of fins or keels attached to a watercraft surface that contacts water is to provide dimensional stability and control of watercraft while moving or propelled through water either on water surface or submerged. The present invention improves on existing designs by providing an increased area of lateral flex (leading edge to trailing edge), and a reduction of fin or keel volume by modification to fin or keels cross sectional profile which is not featured in existing designs. The number, shape, size, and location of fins or keels is dependent on the desired function and performance of said watercraft. For example, as a watercraft moves through water in a forward direction the water flow and water pressure or hydrodynamic pressure are equal on either side of a fin or keel. As direction of watercraft changes (i.e. Turning or tacking) water pressure or hydrodynamic pressure increases on the turns inner radius side of fin or keel and decreases on the turns outer radius side of fin or keel surface. When the water pressure or hydrodynamic pressure becomes too great on the inner radius side of fin or keel and too deficient on the outer radius side of fin or keel the low pressure side produces a low pressure core in the laminar flow boundary resulting in cavitating flow. At the point when a fin or keel produces cavitating flow the fin or keel loses the ability to provide dimensional stability resulting in the loss of control of watercraft by operator. The invention as presented provides several novel improvements over current or traditional fin or keel designs.

Borrowing from the natural design of the fins of fish and cetaceans also known as biomimicry, the invention as presented increases efficiency and improves performance of fins or keels by reducing cavitating flow during directional changes by allowing the rear portion of fin or keel to react by flexing laterally in proportion to increasing water pressure on fin or keel surface experienced while turning or tacking of said watercraft. The invention as presented provides novel improvements over conventional cross sectional fin or keel profiles by reducing the total volume of fin or keel by orientating the greater volume of fin or keel to the leading edge portion of said fin or keel and decreasing the volume of said fin or keels trailing edge portion. There are several patents directed toward fins or keels featuring a lateral flex component employed for dimensional stability and control of surface planing or submerged watercraft. These devices are limited in their functionality by the degree of lateral flex, the distribution of lateral flex area, total volume of fin or keel and the cross sectional profile of fin or keel.

Lewis, U.S. Pat. No. 5,480,331 discloses a flexible fin for surfboards comprised of a fiberglass core sandwiched between two closed cell polyurethane foam surface layers.

Skedeleski/Arakawa, U.S. Pat. No. 5,306,188 discloses a surfboard fin consisting of a rigid body element with a soft flexible material covering the leading and trailing edges of fin. The soft flexible leading edge and the soft flexible trailing edge reduces injury from impact of fin to surfer and provides a rudder action by flexing during turns.

Additional advantages are an increase in watercraft speed by reducing turbulence of laminar flow exiting fins or keels and reduction of fin or keel weight by reduction of fin or keel volume. Additional advantages, objects, and novel features will become apparent when reviewing the detailed description and claims in conjunction with the detailed drawings.

BRIEF SUMMARY OF INVENTION

The present invention consists of a rigid convex leading edge foil element located at the forward leading edge of fin or keel curving from the leading edge end point of fin or keel base to the fin or keel tip and the tapering trailing edge of rigid convex foiled fin or keel element curving from fin or keel tip to fin or keel base terminating tapered trailing edge end point of fin or keel base, comprising 50-69% of total fin or keel area. Rigid convex leading edge foil element can be modified by orientation, total area, type of material to produce the desired stiffness as required by application or use. A thin flexible trailing edge element located at the rear tapered trailing edge of rigid convex leading edge element extending to trailing edge of fin or keel and curving from fin or keel tip to fin or keel base terminating at the tapered trailing edge end point of fin or keel base comprising 40-50% of total fin or keel area. The invention as presented provides novel improvements over conventional fin or keel cross sectional profiles by reducing the total volume of said fin or keel by orientating the greater volume of fin or keel to the leading edge portion of fin or keel and decreasing the volume of fin or keels trailing edge portion. Thin flexible trailing edge element can be modified by orientation, total area, and type of material to produce desired flexibility as required by application or use.

BRIEF DESCRIPTION

A stabilizing fin or keel may vary in size ands shape but several design features are fundamental consisting of a vertical plane, a radius leading edge curving from the frontal end point of fin or keel base to the fin or keel tip, a tapered trailing edge curving from the rear end point of fin or keel base to the fin or keel tip, a fin or keel tip where leading and trailing edges intersect, and a fin or keel base wherefin or keel is attached perpendicular to watercraft surface contacting water by either mechanical means or permanently bonded to the surface of a watercraft. The present invention is a fin or keel that extends perpendicular to a surface of a watercraft contacting water comprising of a rigid leading edge convex foil element (FIG. 1 #14) curving from fin or keel base frontal end point to fin or keel tip, a rigid convex foiled trailing edge curving from fin or keel tip terminating at rear trailing edge end point of fin or keel base comprising 50-60% of total fin or keel area. Rigid leading edge convex foil element can be modified by orientation, total area and type of material to produce desired stiffness as required by application or use. A thin flexible trailing edge element (FIG. 1 #18} extending from the trailing edge of rigid convex leading edge element to the trailing edge of fin or keel from fin or keel tip to fin or keel base terminating at trailing edge end point of fin or keel base comprising 40-50% of total fin or keel area. The invention as presented provides novel improvements over conventional cross sectional fin or keel profiles by reducing the total volume of said fin or keel by orientating the greater volume of fin or keel to the leading edge portion of fin or keel and decreasing the volume of fin or keels trailing edge portion. Thin flexible trailing edge element can be modified by orientation, total area, and type of material to produce desired flexibility as required by application or use. A flat base of fin or keel extending from leading edge end point to trailing edge end point providing a means of attachment by mechanical means or permanently bonded.

DETAILED DESCRIPTION OF THE INVENTION

The present invention relates to fins and keels that are utilized for dimensional stability and control of watercraft in motion planing on water surface or submerged.

The present invention improves on current fin or keel designs by utilizing a thin flexible element positioned in the rear trailing edge area of fin or keel and providing leading edge to trailing edge lateral flex to fin or keel providing increased stability, control, and efficiency of a surface planing or submerged watercraft in motion by reducing a fin or keels development of a cavitating flow in the laminar flow boundary, reducing turbulence in laminar flow exiting a fin or keel and reducing fin or keel weight. Cavitating flow occurs when water pressure or hydrodynamic increases on the inner radius side of fin or keel and decreases on the outer radius side of fin or keel during directional changes (i.e. turns or tacks). When the water pressure or hydrodynamic pressure becomes too great on the inner radius side of fin or keel and too deficient on the outer radius side of fin or keel a low pressure core develops in the laminar flow boundary resulting in cavatating flow and the loss of fin or keels ability to provide directional stability. The present invention reduces cavitating flow by providing an increased flexible trailing edge area which allows lateral flexibility of fin or keel from leading edge to trailing edge whereas current designs provide a minimal amount of lateral flex. Utilizing design elements occurring in nature also known as biomimicry (see reference-Janine Benyus/Biomimicry:Innovation inspired by nature-1997) and more specifically relating to the fins of fish and cetaceans, the present invention provides a reduction of a fin or keels development of cavitating flow during directional changes or turns by utilizing an increased flexible element area which flexes laterally in response to increasing water pressure or hydrodynamic pressure on the inner radius side of a fin or keel during a directional change providing an increase in efficiency and control of a watercraft in motion by reducing cavitational flow.

The present invention consists of a rigid convex foiled leading edge element comprising of the frontal edge of rigid convex foil element curving from fin or keel base frontal end point to fin or keel tip and a foiled trailing edge of rigid convex foil element curving from fin or keel tip to trailing edge rear end point of fin or keel base comprising 50-60% of total fin or keel area, rigid convex leading edge foil element can be modified by orientation, total area, and type of material to produce desired stiffness as required by application or use. A thin flexible trailing edge element extending from trailing edge of rigid convex foil element to fin or keel trailing edge and curving from fin or keel tip to fin or keel base terminating at trailing edge end point of fin or keel base comprising 40-50% of total fin or keel area, thin flexible trailing edge element can be modified by orientation, total area, and type of material to produce the desired flexibility as required by application or use.

In order for the leading edge element to provide the desired rigidity a very stiff material such as but not limited to plastic, resin laminated composites, and fiberglass are used. In order for the flexible trailing edge element to provide the desired resilience and flexibility materials such as but not limited to plastic, resin laminated composites and fiberglass can be used. The material or materials utilized are dependent on the requirements of the invention as applied to the specific use. For example the materials utilized in the manufacture of the invention for use at low speeds will differ from the materials utilized in the manufacture of the invention for use at higher speeds. Rigid convex leading edge element and thin flexible trailing edge element are formed during manufacture to produce one unitary piece.

The invention as presented provides novel improvements over conventional cross sectional fin or keel profiles by reducing the total volume of fin or keel by orientating the greater volume of said fin or keel to the leading edge portion of fin or keel and decreasing the volume of fin or keels trailing edge portion.

In one embodiment of the invention a fin or keel attached to the bottom surface positioned in the rear area of a surfboard providing dimensional stability to the rider. A rider standing on the top of a surfboard riding a wave will initiate a turn by shifting their weight or leaning in the direction they desire the surfboard to turn. During a turn water pressure increases on the inner radius side of fin and water pressure decreases on the outer radius side of fin. During extreme turns water pressure greatly increases on the fins inner radius side and greatly decreases on the outer radius side of fin. When water pressure decreases to a critical point on the outer radius side of fin a low pressure core develops in the laminar flow boundary producing cavitational flow and loss of dimensional stability of fin or keel resulting in loss of control of surfboard by the rider. In this embodiment of the present invention the increase in trailing edge lateral flex area releases water pressure on inner radius side of fin or keel reducing the development of a low pressure core and cavitational flow. The present invention provides a reduction of disproportionate water pressure on fin surfaces during directional changes (turns, tacks) providing dimensional stability to watercraft in motion. Additional advantages, objects and novel features will become apparent when reviewing the detailed description of drawings and claims in conjunction with the detailed description.

The present invention provides several improvements on current designs (reference-Skedeleski-U.S. Pat. No. 5,306,188, Lewis-U.S. Pat. No. 5,480,331) by incorporating a thin flexible trailing edge element allowing for greater lateral flex of said fin or keel. In one embodiment of the present invention a fin attached to a surfboard perpendicular to the bottom surface of a surfboard in the rear area of a surfboard providing dimensional stability to the rider. A rider standing on the top surface of a surfboard riding a wave will initiate a turn by shifting their weight or leaning in the direction they desire the surfboard to turn. During a turn water pressure or hydrodynamic pressure increases on turns inner radius side of fin and decreases on the turns outer radius side of fin. During extreme turns water pressure or hydrodynamic pressure greatly increases on the turns inner radius side of fin and significantly decreases on the outer radius side of fin. When the water pressure or hydrodynamic pressure on the outer radius side of fin decreases to a critical point the fin develops a low pressure core in the laminar flow boundary producing cavitating flow causing loss of dimensional stability of fin or keel resulting in rider losing control of surfboard. In this embodiment of the present invention the increased area of the flexible trailing edge element provides lateral flex resulting in the release of water pressure or hydrodynamic pressure on the fin or keels inner radius side and reducing the decrease in water pressure or hydrodynamic pressure on the outer radius side of fin or keel therefore reducing the development of a low pressure core and subsequent cavitating flow in the laminar flow boundary. The present invention provides a reduction in disproportionate water pressure or hydrodynamic pressure on fin or keel surfaces during directional changes (turns, tacks) and provides greater dimensional stability of a watercraft in motion on water surface or submerged. Additional advantages, objects, and novel features will become apparent when reviewing the detailed description and claims in conjunction with drawings and description of drawings.

REFERENCES CITED

| | | |
|---|---|---|
| 5,306,188 | Skedeleski | Apr. 26, 1994 |
| 5,480,331 | Lewis | Jan. 2, 1996 |

Reference for term biomimicry Janine Benyus—Biomimicry: Innovation Inspired by Nature—1997

DETAILED DESCRIPTION OF DRAWINGS

Figure 1:
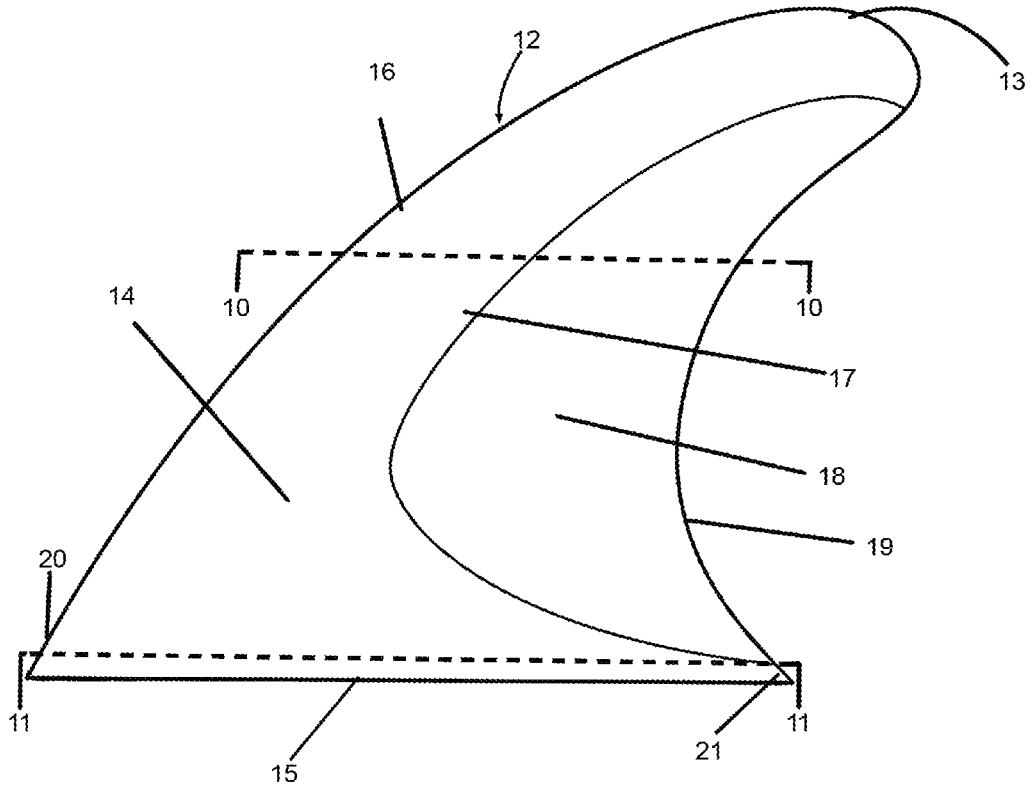
FIG. 1 Is a side perspective view of stabilizing fin of present invention
Figure 2:
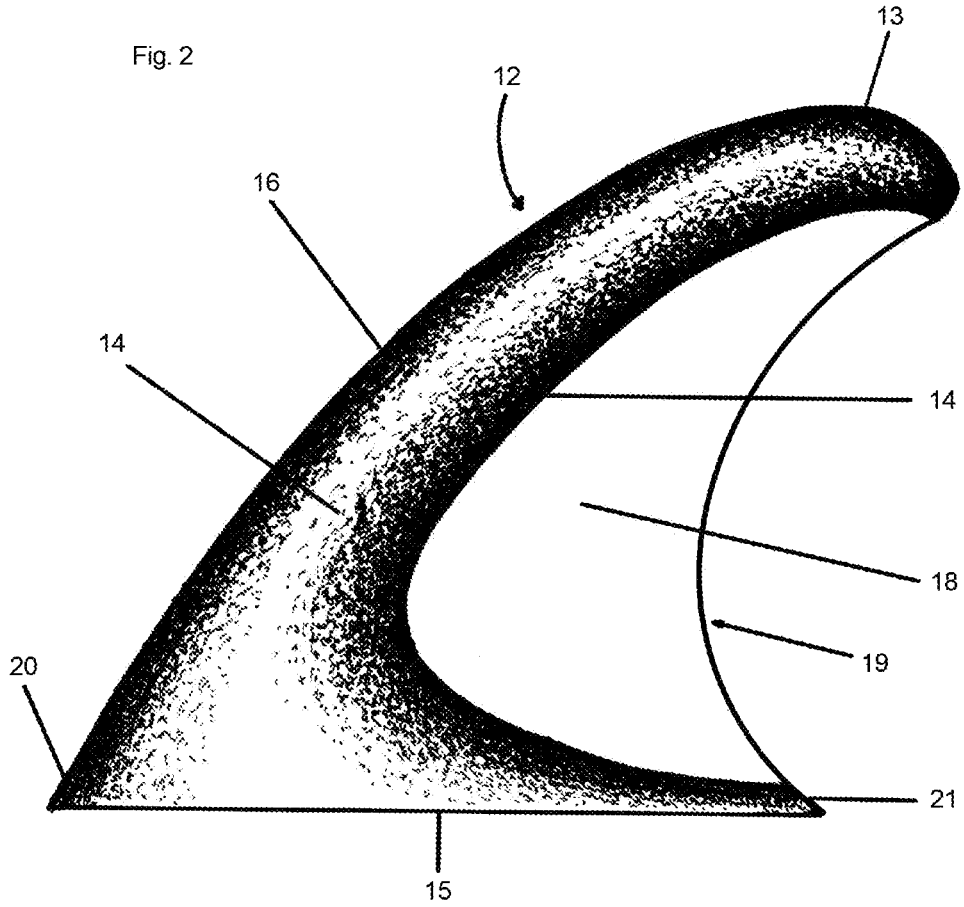
FIG. 2 Is a side perspective view of stabilizing fin illustrating surface contours of the present invention FIG. 3 Is a front perspective view of stabilizing fin of the present invention FIG. 4 Is a rear perspective view of stabilizing fin of the present invention showing rigid element #14 and flexible element #18
Figure 3:
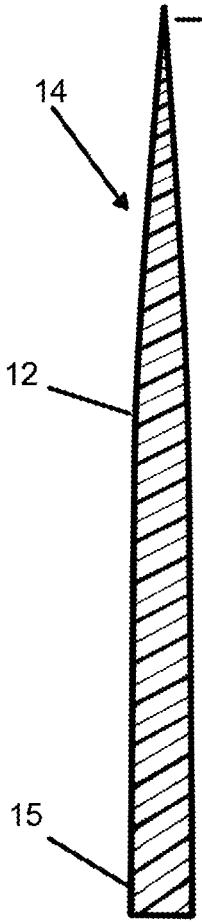
Figure 4:
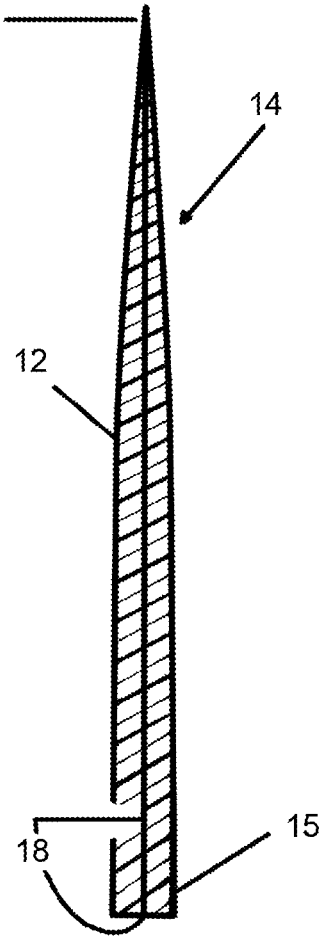
Figure 5:
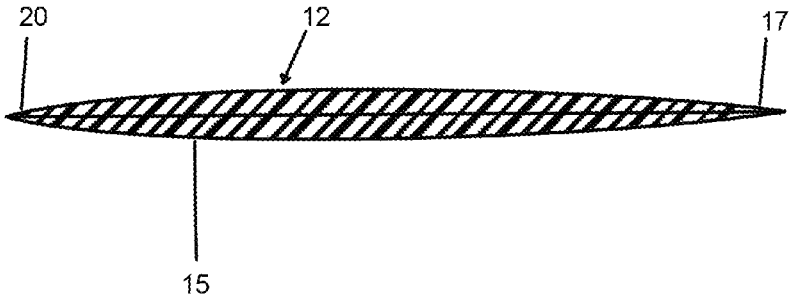
FIG. 5 Is a cross sectional perspective view of stabilizing fin of the present invention taken along lines 11-11 showing the rigid element of the stabilizing fin at fin base FIG. 6 Is a cross sectional perspective view of stabilizing fin of the present invention taken along lines 10-10 showing rigid element #14 and flexible element #18
Figure 6:
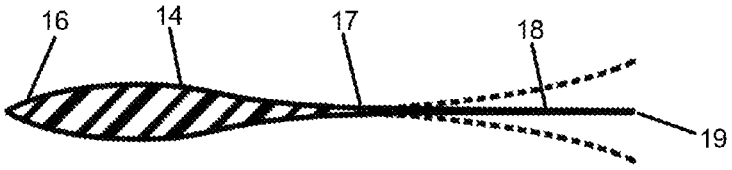
Figure 7:
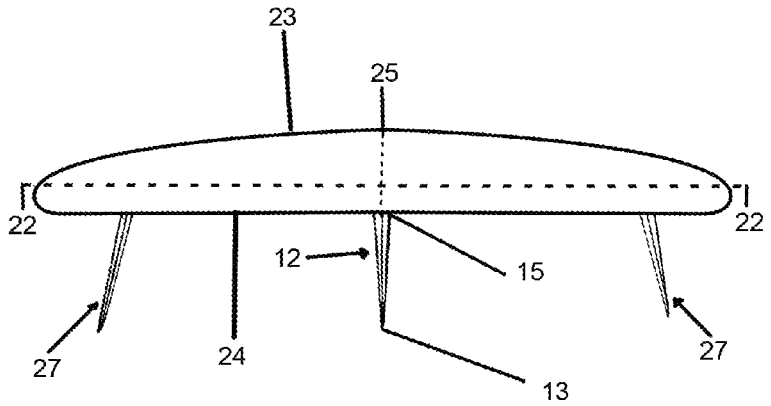
FIG. 7 Is a cross sectional view of a surfboard taken along lines 22-22 of FIG. 7 showing the location of the stabilizing fins of the present invention's attachment to the bottom surface of a surfboard FIG. 8 Is a side perspective view of surfboard showing location of stabilizing fins of the present invention attached to bottom surface of surfboard at rear area of surfboard FIG. 9 Is a bottom perspective view of surfboard showing center line #25 and stabilizing fins location in rear area of surfboard illustrating flexible component of stabilizing fins of the present invention by dotted lines
Figure 8:
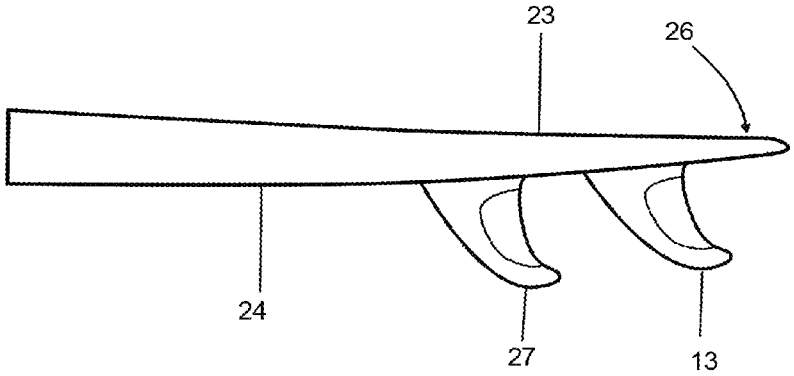
Figure 9:
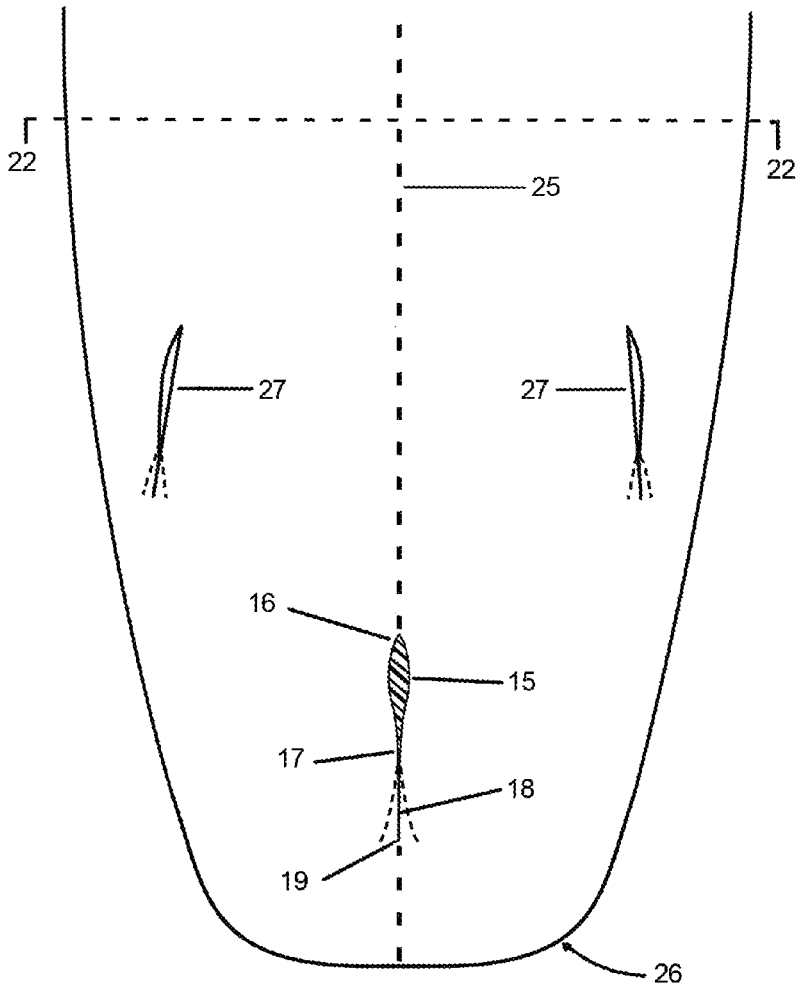

10. cross sectional view taken along lines 10-10 of FIG. 1
11. cross sectional view taken along lines 11-11 of FIG. 1
12. fin (center)
13. fin tip
14. rigid convex foil element
15. rigid convex foil element fin base
16. leading edge rigid convex foil element—FIG. 1
17. trailing edge rigid convex foil element—FIG. 1
18. thin flexible element—FIG. 1
19. trailing edge thin flexible element—FIG. 1
20. leading edge rigid convex foil element fin base—FIG. 1
21. trailing edge rigid convex foil element—FIG. 1
22. cross section of rear area of surfboard taken along lines 22-22 FIG. 1
23. surfboard top surface—FIG. 7
24. surfboard bottom surface—FIG. 7
25. center line of surfboard—FIG. 9
26. rear or tail section of surfboard—FIG. 9
27. left side fin and right side fin

The invention claimed is:

1. A stabilizing fin or keel utilizing biomimic design for surface planing or submerged watercraft comprised of a flat base extending from a frontal leading edge end point to a trailing edge rear end point and providing an area for attachment to a watercraft surface by either mechanical means or permanent bonding;

a vertical rigid convex foil leading edge element having a leading edge curving from said frontal leading edge end point of said fin or keel base to a fin or keel tip, first and second surfaces extending from the leading edge and terminating at a trailing edge curving from said fin or keel tip to said trailing edge rear end point of said fin or keel base, wherein both leading edge and trailing edge intersect at said fin or keel tip;

said rigid convex foil leading edge element comprising 50-60% of a total area of said fin or keel, a vertical trailing edge element comprising a thin flexible material of constant cross sectional thickness extending from said trailing edge of said rigid convex foil leading edge element and curving from said fin or keel tip to said trailing edge rear end point of said base;

said vertical trailing edge element comprising 40-50% of said total area of said fin or keel, wherein, during use, said flexible trailing edge element is configured to react to increasing water pressure or hydrodynamic pressure on an inner radius surface of said fin or keel during a directional change (turn, tack) by flexing laterally and reducing disproportionate water pressure or hydrodynamic pressure on fin or keel surfaces and decreasing the development of a low pressure core and subsequent cavitation flow in the laminar flow boundary of outer radius side of said fin or keel, thus improving dimensional stability and control of a watercraft to which the fin or keel is attached.

2. The stabilizing fin or keel of claim 1 whereas the leading edge rigid convex foil element and the thin flexible trailing edge element are formed during manufacture to produce one unitary piece.

3. The fin or keel of claim 2, further comprising an incurvate inflection point at which said trailing edge of rigid convex leading edge element terminates and said vertical trailing edge element extends to said trailing edge of said fin or keel, said trailing edge of said fin or keel curving from said fin or keel tip to said trailing edge rear end point of said fin or keel base, wherein both leading edge and trailing edge intersect at said fin or keel tip, whereas said incurvate inflection point of said fin or keel provides efficient laminar flow across said fin or keel surface at area of transition of said fin or keel rigid convex leading edge element to trailing edge element of constant cross sectional thickness.

4. The fin or keel of claim 3 is made of a fiber reinforced composite material or plastic.

* * * * *